US011046919B2

(12) United States Patent
Li et al.

(10) Patent No.: US 11,046,919 B2
(45) Date of Patent: Jun. 29, 2021

(54) LIQUID LAUNDRY DETERGENT COMPOSITION

(71) Applicant: The Procter & Gamble Company, Cincinnati, OH (US)

(72) Inventors: Fei Li, Beijing (CN); Ming Tang, Beijing (CN); Yu Guo, Beijing (CN); Biyan Huang, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 16 days.

(21) Appl. No.: 16/436,957

(22) Filed: Jun. 11, 2019

(65) Prior Publication Data

US 2019/0390141 A1 Dec. 26, 2019

(30) Foreign Application Priority Data

Jun. 26, 2018 (WO) ..... PCT/CN2018/092765

(51) Int. Cl.

| | |
|---|---|
| ***C11D 1/22*** | (2006.01) |
| ***C11D 1/29*** | (2006.01) |
| ***C11D 1/72*** | (2006.01) |
| ***C11D 1/83*** | (2006.01) |
| ***C11D 3/26*** | (2006.01) |
| ***C11D 3/37*** | (2006.01) |
| ***C11D 11/00*** | (2006.01) |
| *C11D 1/12* | (2006.01) |
| *C11D 1/14* | (2006.01) |
| *C11D 1/722* | (2006.01) |

(52) U.S. Cl.

CPC ..... *C11D 3/3723* (2013.01); *C11D 1/83* (2013.01); *C11D 11/0017* (2013.01); *C11D 1/12* (2013.01); *C11D 1/14* (2013.01); *C11D 1/22* (2013.01); *C11D 1/29* (2013.01); *C11D 1/72* (2013.01); *C11D 1/722* (2013.01)

(58) Field of Classification Search

CPC .... C11D 1/12; C11D 1/14; C11D 1/22; C11D 1/29; C11D 1/72; C11D 1/722; C11D 1/83; C11D 3/3723

USPC ..... 510/351, 352, 353, 357, 360, 475, 499, 510/505, 506

See application file for complete search history.

(56) References Cited

U.S. PATENT DOCUMENTS 5,904,735 A 5/1999 Gutierrez
7,928,050 B2 4/2011 Schneiderman
(Continued)

FOREIGN PATENT DOCUMENTS

EP 2135934 B1 11/2011
EP 2476743 B1 4/2013
(Continued)

OTHER PUBLICATIONS

AA1298 PCT Search Report for appl. No. PCT/CN2018/092765, dated Apr. 2, 2019, 4 pages.
(Continued)

*Primary Examiner* — Gregory R Delcotto
(74) *Attorney, Agent, or Firm* — Andrés E. Velarde

(57) ABSTRACT

A liquid laundry detergent with improved soil suspension benefit is provided, which contains a from about 0.1 wt % to about 5 wt % of an alkoxylated polyethyleneimine and a specific surfactant system including both nonionic (NI) surfactant(s) and anionic (AI) surfactant(s) at an NI-to-AI weight ratio of about 1.7-20.

4 Claims, 1 Drawing Sheet

(56) References Cited

U.S. PATENT DOCUMENTS

| | | | | |
|---|---|---|---|---|
| 9,150,993 | B2 | 10/2015 | Bennett | |
| 2009/0105109 | A1 | 4/2009 | Lant | |
| 2011/0237486 | A1* | 9/2011 | Souter | C11D 3/3723 510/321 |
| 2015/0376552 | A1 | 12/2015 | Si et al. | |
| 2017/0015942 | A1 | 1/2017 | Iglesias | |

FOREIGN PATENT DOCUMENTS

| | | | |
|---|---|---|---|
| EP | 2692842 | B1 | 7/2014 |
| EP | 2794833 | B1 | 2/2016 |
| WO | 2009060059 | A2 | 5/2009 |
| WO | 2013170001 | A1 | 11/2013 |
| WO | WO2013171210 | A1 | 11/2013 |
| WO | 2015172284 | A1 | 11/2015 |

OTHER PUBLICATIONS

Supplementary International Search Report; Application Ser. No. PCT/CN2018/092765; dated Sep. 28, 2020; 7 pages.

* cited by examiner

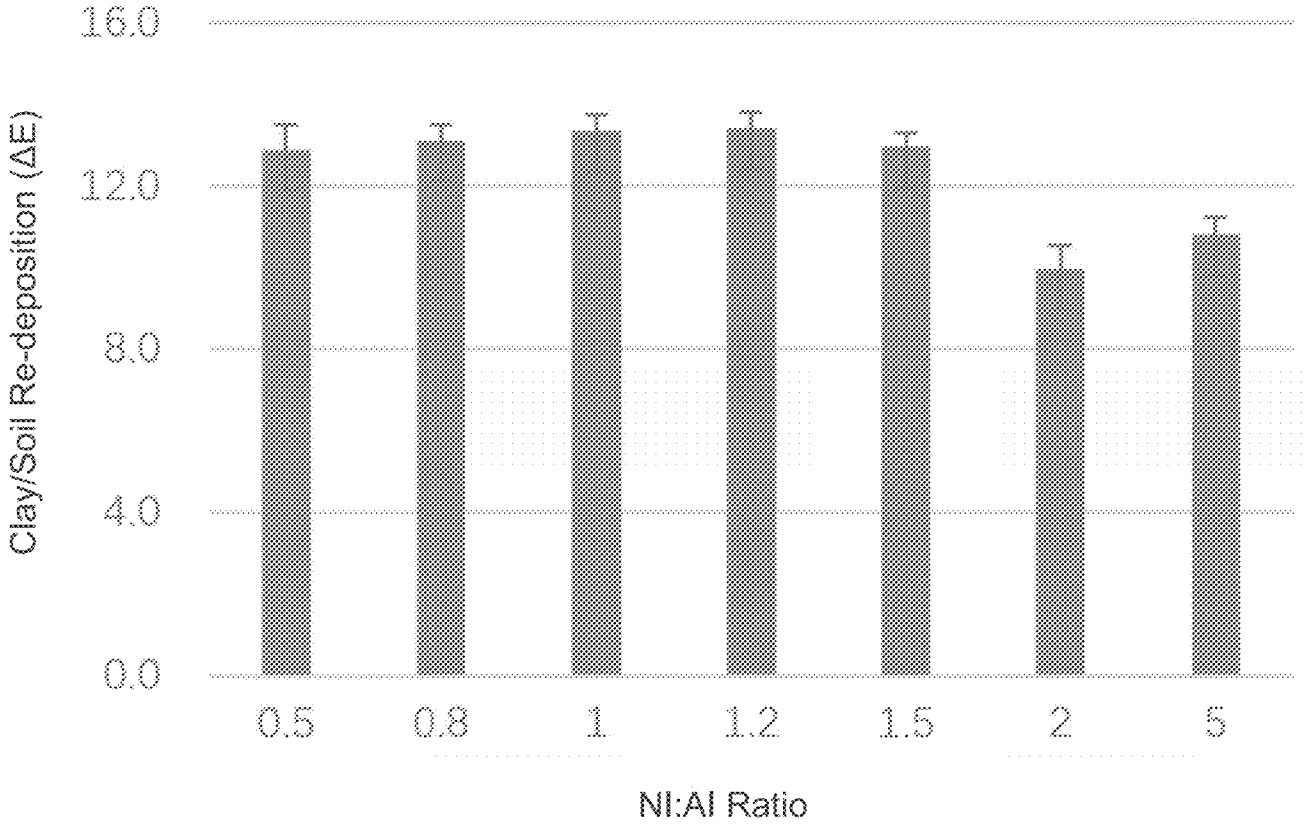
16.0
12.0
8.0
4.0
0.0
Clay/Soil Re-deposition (ΔE)
0.5
0.8
1
1.2
1.5
2
5
NI:AI Ratio

LIQUID LAUNDRY DETERGENT COMPOSITION

FIELD OF THE INVENTION

The present invention relates to a cleaning composition, and particularly a liquid laundry detergent composition that is useful for treating fabrics.

BACKGROUND OF THE INVENTION

Modern day consumers desire laundry detergents that provide excellent overall cleaning benefit with minimal environmental impact. The detergent industry has traditionally utilized surfactants to deliver the cleaning benefit. However, due to increasing environmental concerns, as well as rising costs of raw materials, the conventional way of either solely or heavily relying on surfactants to achieve the cleaning benefit is gradually losing favor with the modern-day consumers.

Correspondingly, laundry detergent manufacturers are exploring new ways to reduce the total amount of surfactants used in their products and to minimize the adverse impact of laundering on the environment, while still providing the consumer with excellent overall cleaning results.

Alkoxylated polyalkyleneimines (APEI) are a group of polymers having a polyalkyleneimine backbone or core that is surrounded by polyalkylene oxide blocks. They have been used as detergent additives in low-surfactant liquid detergent formulations to assist removal of soil from the fabric surface, stabilize suspension of soils dispersed in the wash liquor, and to prevent the suspended soil from redepositing back onto the fabric surface. The use of such APEI polymers enables reduction of the total surfactant level in such liquid laundry detergent products while still providing the consumer with excellent overall cleaning performance Correspondingly, less surfactant is released into the environment after each wash, resulting in reduced environmental "footprint" of such laundry detergent products.

There is a continuing need to further improve the soil removal benefit or cleaning performance of liquid laundry detergent compositions without increasing the total surfactant content therein or enlarging the environmental "footprint" thereof.

SUMMARY OF THE INVENTION

It is a surprising discovery of the present invention that when the liquid laundry detergent compositions employ a specific surfactant system, i.e., one that contains both nonionic (NI) and anionic (AI) surfactants at a specific NI-to-AI weight ratio, in combination with an APEI polymer, the resulting soil removal benefit or cleaning performance is further improved in comparison with APEI-containing liquid laundry detergent compositions that employ a different surfactant system (e.g., with an NI-to-AI weight ratio falling outside of the desired range of the present invention).

In one aspect, the present invention relates to a liquid laundry detergent composition comprising:

a) from 0.1 wt % to 5 wt % of an alkoxylated polyethyleneimine having a polyalkyleneimine core with one or more alkoxy side chains bonded to at least one nitrogen atom in the polyalkyleneimine core; and b) from 6 wt % to 50 wt % of one or more nonionic (NI) surfactants and one or more anionic (AI) surfactants, while the NI-to-AI weight ratio ranges from 1.7 to 20.

In a particularly preferred embodiment, the present invention relates to a liquid laundry detergent composition comprising:

1) from 0.5 wt % to 1 wt % of an alkoxylated polyethyleneimine an empirical formula of (PEI)a-(EO)b-(PO)c-$R_1$, wherein a is the weight average molecular weight of the polyalkyleneimine core (MWPEI) of the alkoxylated polyalkyleneimine and is in the range of from 500 to 2,000 Daltons; wherein b is the weight average degree of ethoxylation in said one or more side chains of the alkoxylated polyalkyleneimine and is in the range of from 15 to 25; wherein c is the weight average degree of propoxylation in said one or more side chains of the alkoxylated polyalkyleneimine and is 0; and wherein $R_1$ is hydrogen;

2) from 9 wt % to 30 wt % of a nonionic (NI) surfactant that is a $C_8$-$C_{18}$ alkyl ethoxylated alcohol having a weight average degree of ethoxylation ranging from 7 to 10; and 3) from 2 wt % to 10 wt % of a $C_{10}$-$C_{20}$ linear alkyl benzene sulphonate (LAS) and a $C_{10}$-$C_{20}$ linear or branched alkylethoxy sulfate (AES) having a weight average degree of ethoxylation ranging from 1 to 3, while the NI-to-AI weight ratio ranges from 2 to 5.

The present invention may also relate to the use of above-described liquid laundry detergent composition for treating fabrics.

These and other features of the present invention will become apparent to one skilled in the art upon review of the following detailed description when taken in conjunction with the appended claims.

BRIEF DESCRIPTION OF THE DRAWINGS

FIG. 1 is a graph plotting the color change (ΔE) caused by clay/soil re-deposition as a function of the NI-to-AI weight ratio in different APEI-containing liquid laundry detergent compositions with the same total surfactant level.

DETAILED DESCRIPTION OF THE INVENTION

As used herein, the articles "a" and "an" when used in a claim, are understood to mean one or more of what is claimed or described.

As used herein, the terms "comprising," "comprises," "include", "includes" and "including" are meant to be non-limiting.

As used herein, the term "substantially free of" or "substantially free from" means that the indicated material is present in an amount of no more than about 5 wt %, preferably no more than about 2%, and more preferably no more than about 1 wt %.

As used therein, the term "essentially free of" or "essentially free from" means that the indicated material is at the very minimal not deliberately added to the composition, or preferably not present at an analytically detectable level in such composition. It may include compositions in which the indicated material is present only as an impurity of one or more of the materials deliberately added to such compositions.

As used herein, the term "liquid" refers to a fluid having a liquid having a viscosity of from about 1 to about 2000 mPa*s at 25° C. and a shear rate of 20 $sec^{-1}$. In some embodiments, the viscosity of the liquid may be in the range of from about 200 to about 1000 mPa*s at 25° C. at a shear rate of 20 $sec^{-1}$. In some embodiments, the viscosity of the liquid may be in the range of from about 200 to about 500 mPa*s at 25° C. at a shear rate of 20 $sec^{-1}$.

Unless otherwise specified, the term "molecular weight" as used herein refers to the weight average molecular weight (MWw) of the polymer chains in a polymer composition, which may be calculated using the equation:

$$MWw=(\Sigma i\ Ni\ Mi^2)/(\Sigma i\ Ni\ Mi)$$

wherein Ni is the number of molecules having a molecular weight Mi.

Unless otherwise specified, the term "alkyl" as used herein means a $C_1$-$C_{10}$ hydrocarbyl moiety which can be linear or branched, substituted or unsubstituted.

As used herein, the term "hydrocarbyl" is defined herein as any organic unit or moiety which is comprised of carbon atoms and hydrogen atoms. Included with the definition of "hydrocarbyl" are the aromatic (aryl) and non-aromatic carbocyclic rings. Further included within the term hydrocarbyl are heterocycles. The term "heterocycle" includes both aromatic (heteroaryl) and non-aromatic heterocyclic rings.

All temperatures herein are in degrees Celsius (° C.) unless otherwise indicated. Unless otherwise specified, all measurements herein are conducted at 25° C. and under the atmospheric pressure. In all embodiments of the present invention, all percentages are by weight of the total composition, unless specifically stated otherwise. All ratios are weight ratios, unless specifically stated otherwise.

It is understood that the test methods that are disclosed in the Test Methods Section of the present application must be used to determine the respective values of the parameters of Applicants' inventions are described and claimed herein.

Alkoxylated Polyalkyleneimine (APEI)

The liquid laundry detergent composition of the present invention contains at least one alkoxylated polyalkyleneimine (APEI), which may be represented as containing repeating units of formulae (1), (2), (3) and (4)

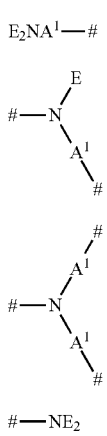

wherein:

- # in each case denotes one-half of a bond between a nitrogen atom and the free binding position of a group $A^1$ of two adjacent repeating units of formulae (1), (2), (3) or (4);
- $A^1$ is independently selected from linear or branched $C_2$-$C_6$ alkylene;
- E is independently selected from alkylenoxy units of the formula (5):

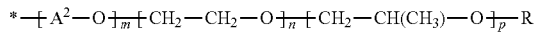

wherein:

- * in each case denotes the bond to the nitrogen atom of the repeating unit of formula (1), (2) or (4);
- $A^2$ is in each case independently selected from 1,2-propylene, 1,2-butylene and 1,2-isobutylene;
- R is in each case independently selected from hydrogen and $C_1$-$C_4$-alkyl;
- m has a weight average value in the range of from 0 to about 2;
- n has a weight average value in the range of from about 20 to about 50; and
- p is a rational number from about 10 to about 50;

the individual APEIs consisting of 1 repeating unit of formula (1), x repeating units of formula (2), y repeating units of formula (3) and y+1 repeating units of formula (4), wherein x and y in each case have a value in the range of from 0 to about 150; and the polymer has a degree of quaternization of from 0 to about 50%.

In a simplified representation, the APEIs of the present invention can be considered as having a polyalkyleneimine core with one or more alkoxy side chains bonded to at least one nitrogen atom in the polyalkyleneimine core. The polyalkyleneimine core is formed by the repeating units of formulae (1), (2), (3) and (4) as described hereinabove, but minus the alkylenoxy units E. The one or more alkoxy side chain is formed by alkylenoxy units E as described hereinabove, preferably has an inner polyethylene oxide block and an outer polypropylene oxide block.

The APEIs of the present invention may be represented by an empirical formula of:

$$(PEI)a\text{-}(EO)b\text{-}(PO)c\text{-}R_1$$

Specifically, a is the weight average molecular weight of the polyalkyleneimine core (MWPEI) of the alkoxylated polyalkyleneimine and is in the range of from 100 to 100,000 Daltons, preferably from 200 to 20,000 Daltons, more preferably from 500 to 2,000 Daltons. Further, b is the weight average degree of ethoxylation in said one or more side chains of the alkoxylated polyalkyleneimine and is in the range of from 5 to 40, preferably from 10 to 30, more preferably from 15 to 25. Still further, c is the weight average degree of propoxylation in said one or more side chains of the alkoxylated polyalkyleneimine which ranges from 0 to 50, preferably from 0 to 30, more preferably from 0 to 20. The terminal group $R_1$ is independently selected from the group consisting of hydrogen, $C_1$-$C_4$ alkyl, and combinations thereof.

In a preferred embodiment of the present invention, the liquid laundry detergent composition contains at least a first APEI that can be represented by an empirical formula of $(PEI)_{500\text{-}2000}(EO)_{15\text{-}25}$.

Optionally, the liquid laundry detergent composition of the present invention may further contain a second APEI that can be represented by an empirical formula of $(PEI)_{500\text{-}2000}(EO)_{15\text{-}25}(PO)_{10\text{-}20}$. If both are present, the weight ratio between such first and second APEIs may range from about 1:1 to about 10:1, preferably from about 1:1 to about 5:1, more preferably from about 1:1 to about 2:1.

The above-described APEIs may be present in the liquid laundry detergent composition of the present invention in an amount ranging from about 0.1 wt % to about 5 wt %, preferably from about 0.2 wt % to about 3 wt %, more preferably from about 0.5 wt % to about 1 wt %. In a particularly preferred embodiment, the liquid laundry detergent composition contains from about 0.5 wt % to about 1 wt % of an APEI having an empirical formula of $(PEI)_{500-2000}(EO)_{15-25}$.

Surfactant System

In addition to the APEIs described hereinabove, the liquid laundry detergent composition of the present invention also includes a surfactant system comprising one or more surfactants selected from the group consisting of anionic surfactants, nonionic surfactants, zwitterionic surfactants, amphoteric surfactants, cationic surfactants, and combinations thereof. The total surfactant content of such liquid laundry detergent composition may range from about 10% to about 90%, preferably from about 10% to about 80%, more preferably from about 15% to about 60% by total weight of the composition.

It is an important feature of the present invention that the surfactant system of the liquid laundry detergent composition comprises both nonionic (NI) and anionic (AI) surfactants at a specific NI-to-AI weight ratio ranging from about 1.7 to about 20, preferably from about 1.8 to about 10, more preferably from about 2 to about 5. The total amount of NI and AI surfactants in the liquid laundry detergent composition may range from about 6 wt % to about 50 wt %, preferably from about 10 wt % to about 40 wt %, more preferably from about 12 wt % to about 30 wt %.

Nonionic surfactants that can be included into the liquid laundry detergent composition of the present invention may be any conventional nonionic surfactants, including but not limited to: alkyl alkoxylated alcohols, alkyl alkoxylated phenols, alkyl polysaccharides, polyhydroxy fatty acid amides, and the like. Preferred nonionic surfactants are those of the formula $R^1(OC_2H_4)_nOH$, wherein $R^1$ is a $C_8$-$C_{18}$ alkyl group or alkyl phenyl group, and n is from about 1 to about 80. Particularly preferred are $C_8$-$C_{18}$ alkyl ethoxylated alcohols having a weight average degree of ethoxylation from about 1 to about 20, preferably from about 5 to about 15, more preferably from about 7 to about 10, such as NEODOL® nonionic surfactants commercially available from Shell.

Other non-limiting examples of nonionic surfactants useful herein include: $C_6$-$C_{12}$ alkyl phenol alkoxylates where the alkoxylate units may be ethyleneoxy units, propyleneoxy units, or a mixture thereof; $C_{12}$-Cis alcohol and $C_6$-$C_{12}$ alkyl phenol condensates with ethylene oxide/propylene oxide block polymers such as Pluronic® from BASF; $C_{14}$-$C_{22}$ mid-chain branched alcohols (BA); $C_{14}$-$C_{22}$ mid-chain branched alkyl alkoxylates, $BAE_x$, wherein x is from 1 to 30; alkyl polysaccharides, specifically alkyl polyglycosides; Polyhydroxy fatty acid amides; and ether capped poly (oxyalkylated) alcohol surfactants. Suitable nonionic surfactants also include those sold under the tradename Lutensol® from BASF.

The nonionic surfactants can be provided in the liquid laundry detergent compositions of the present invention at levels ranging from about 5 wt % to about 45 wt %, preferably from about 8 wt % to about 40 wt %, more preferably from about 9 wt % to about 30 wt %. In one particularly preferred embodiment, the liquid laundry detergent composition contains from about 9 wt % to about 30 wt % of a $C_8$-$C_{18}$ alkyl ethoxylated alcohol having a weight average degree of ethoxylation ranging from 7 to 10.

Anionic surfactants that are used in the liquid laundry detergent compositions of the present invention are preferably non-soap synthetic anionic surfactants, such as the water-soluble salts, preferably the alkali metal salts and/or ammonium salts, of organic sulphonic reaction products having in their molecular structure an alkyl group (included in the term "alkyl" is the alkyl portion of acyl groups) containing from about 10 to about 20 carbon atoms and a sulphonic/phosphonic acid or sulfuric/phosphoric acid ester group. Examples of suitable synthetic anionic surfactants include, but are not limited to: $C_{10}$-$C_{20}$ linear alkyl benzene sulphonates, $C_{10}$-$C_{20}$ linear or branched alkyl sulfates, $C_{10}$-$C_{20}$ linear or branched alkylethoxy sulfates having a weight average degree of ethoxylation ranging from 0.1 to 5.0, $C_{10}$-$C_{20}$ linear or branched alkyl ester sulfates, $C_{10}$-$C_{20}$ linear or branched alkyl sulphonates, $C_{10}$-$C_{20}$ linear or branched alkyl ester sulphonates, $C_{10}$-$C_{20}$ linear or branched alkyl phosphates, $C_{10}$-$C_{20}$ linear or branched alkyl phosphonates, $C_{10}$-$C_{20}$ linear or branched alkyl carboxylates, and combinations thereof (including their sodium, potassium, and/or ammonium salts).

Especially preferred for the practice of the present invention are anionic surfactants containing $C_{10}$-$C_{20}$ linear alkyl benzene sulphonates (LAS) and $C_{10}$-$C_{20}$ linear or branched alkylethoxy sulfates (AES) having a weight average degree of ethoxylation ranging from about 0.1 to about 5, preferably from about 0.5 to about 4, more preferably from about 1 to about 3. In a particularly preferred embodiment of the present invention, the liquid laundry detergent composition comprises both the LAS and AES.

The anionic surfactants can be provided in the liquid laundry detergent compositions of the present invention at levels ranging from about 0.5 wt % to about 15 wt %, more preferably from about 1 wt % to about 12 wt %, and more preferably from about 2 wt % to about 10 wt %. In one particularly preferred embodiment, the liquid laundry detergent composition contains from about 2 wt % to about 10 wt % of LAS and AES, while the AES has a weight average degree of ethoxylation ranging from 1 to 3, and the weight ratio between LAS and AES ranges from 1:2 to 5:1, preferably from 1:1 to 4:1, more preferably from 1.5:1 to 3:1. Most preferably, the NI-to-AI (i.e., LAS+AES) weight ratio ranges from about 2 to about 5.

Other surfactants useful herein include amphoteric surfactants, zwitterionic surfactants and cationic surfactants. Such surfactants are well known for use in laundry detergents and are typically present at levels from about 0.2 wt %, 0.5 wt % or 1 wt % to about 10 wt %, 20 wt % or 30 wt %.

In a preferred but not necessary embodiment of the present invention, the liquid laundry detergent composition further contains from about 0.5 wt % to about 20 wt % of one or more amphoteric and/or zwitterionic surfactants.

Preferred amphoteric surfactants are selected from the group consisting of amine oxide surfactants, such as, for example, alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides are characterized by a formula $R_1$—$N(R_2)(R_3)$—O, wherein $R_1$ is a $C_{8-18}$ alkyl, and wherein $R_2$ and $R_3$ are independently selected from the group consisting of $C_{1-3}$ alkyls and $C_{1-3}$ hydroxyalkyls, such as methyl, ethyl, propyl, isopropyl, 2-hydroxethyl, 2-hydroxypropyl and 3-hydroxypropyl. As used herein "mid-branched" means that the amine oxide has one alkyl moiety having n1 carbon atoms with one alkyl branch on the alkyl moiety having n2 carbon atoms. The alkyl branch is located on the $\alpha$ carbon from the nitrogen on the alkyl moiety. This type of branching for the amine oxide is also known in the art as an internal amine oxide. The total sum of n1 and n2 is from about 10 to about 24 carbon atoms, preferably from about 12 to about 20, and more preferably from about 10 to about 16. The number of carbon atoms for the one alkyl moiety (n1) should be approximately the same number of carbon atoms as the one alkyl branch (n2) such that the one alkyl moiety and the one alkyl branch are symmetric. As used herein "symmetric" means that $|n1-n2|$ is less than or equal to 5, preferably 4, most preferably from 0 to 4 carbon atoms in at least about 50 wt %, more preferably at least about 75 wt % to about 100 wt %, of the mid-branched amine oxides for use herein. Particularly preferred amphoteric surfactants are $C_{10}$-$C_{14}$ alkyl dimethyl amine oxides.

Preferred zwitterionic surfactants are betaine surfactants, such as, for example, alkyl betaines, alkylamidobetaines, amidazoliniumbetaines, sulfobetaines (also referred to as sultaines) as well as phosphobetaines. A particularly preferred betaine is cocoamidopropylbetaine.

Water-soluble salts of the higher fatty acids, i.e., "soaps", are also useful anionic surfactants in the liquid laundry detergent compositions of the present invention, although such soaps are not counted when calculating the NI-to-AI weight ratio in the present invention. Suitable soaps include alkali metal salts (such as the sodium, potassium, ammonium, and alkyl ammonium salts) of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap. However, the liquid laundry detergent compositions of the present invention preferably contain soaps at a relatively low level, e.g., no more than about 3 wt %, more preferably not more than about 2 wt % or 1 wt %, and most preferably said liquid laundry detergent compositions are substantially or essentially free of soaps.

Liquid Laundry Detergent Compositions

The liquid laundry detergent composition of the present invention is suitable for fabric cleaning application, including automatic machine washing or hand-washing of fabrics, or cleaning auxiliaries, such as for example, bleach, rinse aids, additives or pre-treat types.

The liquid laundry detergent composition can be a fully formulated laundry detergent product. Liquid compositions contained in encapsulated and/or unitized dose products are included, as are compositions which comprise two or more separate but jointly dispensable portions. Preferably, the liquid laundry detergent composition contains water as an aqueous carrier, and it can contain either water alone or mixtures of organic solvent(s) with water as carrier(s). Suitable organic solvents are linear or branched lower $C_1$-$C_8$ alcohols, diols, glycerols or glycols; lower amine solvents such as $C_1$-$C_4$ alkanolamines, and mixtures thereof. Exemplary organic solvents include 1,2-propanediol, ethanol, glycerol, monoethanolamine and triethanolamine. The carriers are typically present at levels in the range of from about 0.1% to about 98%, preferably from about 10% to about 95%, more preferably from about 25% to about 75% by total weight of the liquid laundry detergent composition. In some embodiments, water is from about 85 to about 100 wt % of the carrier. In other embodiments, water is absent, and the composition is anhydrous. Highly preferred compositions afforded by the present invention are clear, isotropic liquids.

The liquid laundry detergent composition of the present invention has a viscosity from about 1 to about 2000 centipoise (1-2000 mPa·s), or from about 200 to about 800 centipoises (200-800 mPa·s). The viscosity can be determined using a Brookfield viscometer, No. 2 spindle, at 60 RPM/s, measured at 25° C.

In addition to the ingredients described hereinabove, the liquid laundry compositions of the present invention may comprise an external structurant, which may be present in an amount ranging from about 0.001% to about 1.0%, preferably from about 0.05% to about 0.5%, more preferably from about 0.1% to about 0.3% by total weight of the composition. A particularly preferred external structurant for the practice of the present invention is hydrogenated castor oil, which is also referred to as trihydroxylstearin and is commercially available under the tradename Thixin®.

In addition to those ingredients described hereinabove, the balance of the liquid laundry detergent composition of the present invention typically contains from about 5 wt % to about 70 wt %, or about 10 wt % to about 60 wt % of adjunct ingredients. Suitable adjunct ingredients for laundry detergent products include: builders, chelating agents, dye transfer inhibiting agents, dispersants, rheology modifiers, enzymes, and enzyme stabilizers, catalytic materials, bleach activators, hydrogen peroxide, sources of hydrogen peroxide, preformed peracids, polymeric dispersing agents, clay soil removal/anti-redeposition agents, brighteners, suds suppressors, dyes, photobleaches, structure elasticizing agents, fabric softeners, carriers, hydrotropes, processing aids, solvents, hueing agents, anti-microbial agents, free perfume oils, and/or pigments. The precise nature of these adjunct ingredients and the levels thereof in the liquid laundry detergent composition will depend on factors like the specific type of the composition and the nature of the cleaning operation for which it is to be used.

Methods of Using the Liquid Laundry Detergent Composition

The present invention in one aspect is directed to a method of using the above-described liquid laundry detergent composition for treating fabrics, the method comprising the steps of: (i) providing a liquid laundry detergent composition as described above; (ii) forming a laundry liquor by diluting the liquid laundry detergent composition with water; (iii) washing fabric in the laundry liquor; and (iv) rinsing the fabric in water.

Machine laundry methods may comprise treating soiled fabrics with an aqueous wash solution in a top-loading or front-loading automatic or semi-automatic washing machine having dissolved or dispensed therein an effective amount of a liquid laundry cleaning composition in accord with the invention. An "effective amount" of the liquid laundry detergent composition means from about 20 g to about 300 g of product dissolved or dispersed in a wash solution of volume from about 5 L to about 65 L. The water temperatures may range from about 5° C. to about 100° C. The water to soiled fabric ratio may be from about 1:1 to about 30:1. The liquid laundry detergent compositions may be employed at concentrations of from about 500 ppm to about 15,000 ppm in solution. The detergent dosage levels may also vary depending not only on the type and severity of the soils and stains, but also on the wash water temperature, the volume of wash water, and the type of washing machine (e.g., top-loading, front-loading, vertical-axis Japanese-type automatic washing machine).

The liquid laundry detergent compositions herein may be used for laundering of fabrics at reduced wash temperatures. These methods of laundering fabric comprise the steps of delivering a liquid laundry detergent composition to water to form a wash liquor and adding a laundering fabric to said wash liquor, wherein the wash liquor has a temperature of from about 0° C. to about 20° C., or from about 0° C. to about 15° C., or from about 0° C. to about 9° C. The fabric may be contacted to the water prior to, or after, or simultaneous with, contacting the liquid laundry detergent composition with water.

Hand washing/soak methods, and combined handwashing with semi-automatic washing machines, are also included.

EXAMPLES

Example 1: Comparative Examples Exhibiting Impact of Different NI-to-AI Weight Ratios on Clay/Soil Removal Performance of APEI-Containing Liquid Laundry Detergent Compositions Seven (7) exemplary liquid laundry detergent compositions A-G are provided, all of which contain about 1 wt % of an APEI polymer and about 14.6 wt % of surfactants including both a NI surfactant and two AI surfactants (LAS and AES). The NI-to-AI weight ratios in these exemplary liquid laundry detergent compositions vary from about 0.5 to about 5, e.g., at about 0.5, 0.8, 1, 1.2, 1.5, 2 and 5. Following are the detailed compositional breakdown of the exemplary liquid laundry detergent compositions A-G:

TABLE 1

| Ingredients (wt %) | A | B | C | D | E | F | G |
|---|---|---|---|---|---|---|---|
| Alkoxylated Polyalkyleneimine[1] | 1.00 | 1.00 | 1.00 | 1.00 | 1.00 | 1.00 | 1.00 |
| Neodol ®25-7[2] | 4.87 | 6.49 | 7.30 | 7.96 | 8.76 | 9.73 | 12.17 |
| LAS[3] | 6.53 | 5.44 | 4.90 | 4.45 | 3.92 | 3.27 | 1.63 |
| AE3S[4] | 3.20 | 2.67 | 2.40 | 2.18 | 1.92 | 1.60 | 0.80 |
| Fatty acids | 0.99 | 0.99 | 0.99 | 0.99 | 0.99 | 0.99 | 0.99 |
| Citric acids | 1.39 | 1.39 | 1.39 | 1.39 | 1.39 | 1.39 | 1.39 |
| Sodium Tetraborates | 1.40 | 1.40 | 1.40 | 1.40 | 1.40 | 1.40 | 1.40 |
| sodium Cumene Sulfonate (NaCS) | 0.6 | 0.6 | 0.6 | 0.6 | 0.6 | 0.6 | 0.6 |
| Di-propylene glycol | 1 | 1 | 1 | 1 | 1 | 1 | 1 |
| NaOH | pH Adjusted to 8 | | | | | | |
| Water | Q.S. | Q.S. | Q.S. | Q.S. | Q.S. | Q.S. | Q.S. |
| NI-to-AI Weight Ratio | 0.5 | 0.8 | 1 | 1.2 | 1.5 | 2 | 5 |

[1]An ethoxylated polyethyleneimine with an empirical formula of $PEI_{600}EO_{20}$.
[2]A $C_{12}$-$C_{15}$ alkyl ethoxylated alcohol with a weight average degree of ethoxylation of 7.
[3]A $C_{11}$-$C_{12}$ linear alkylbenzene sulphonate.
[4]A $C_{12-14}$ alkyl ethoxylated sulfate with a weight average degree of ethoxylation of about 3.

Each of the above-described exemplary liquid laundry detergent composition is used to treat fabrics, and then its soil/clay removal performance is measured as follows:

i) Prepare 3 fabric pieces, each of which has a size of about 5 cm×5 cm and contains a 50%/50% polyester-cotton blend;
ii) Measure the L/a/b value of each fabric piece using a Spetro-Guide 45/0 Gloss 6801 color spectrophotometer (commercially available from BYK-Gardner GmbH in Geretsried, Germany), and calculate an average L/a/b value for all 3 pieces of fabric before wash;
iii) Dissolve about 1.6 grams of the sample liquid laundry detergent composition in 800 ml reverse osmosis (RO) water that has a water hardness level of about 200 gpg (with a $Ca^{2+}$-to-$Mg^{2+}$ weight ratio of about 4:1), to form a wash liquor with a detergent dosage of about 2000 ppm;
iv) Add about 1 gram of Arizona Test Dust (ISO12103-1, A2 fine test dust with a nominal particle size of 0-3 micron, commercially available from Powder Technology Inc) into the 800-ml wash liquor from step (iii) to form an even mixture;
v) Add the 3 fabric pieces into the mixture from step (iv) and wash in Tergotometer (Copley Scientific) for about 20 minutes;
vi) Rinse the washed fabric pieces with RO water for about 1 minute and then dry them out;
vii) Measure the L/a/b value of each dried fabric pieces using the same Spetro-Guide 45/0 Gloss 6801 color spectrophotometer and calculate an average L/a/b value for all 3 pieces of fabric after wash; and
viii) Calculate ΔE between the average L/a/b values before and after wash as an indicator of the clay/soil removal performance of the sample liquid laundry detergent composition. The higher the ΔE value, the more clay/soil is redeposited back to the fabric during the wash, and hence the poorer the clay/soil removal performance of the sample liquid laundry detergent composition.

FIG. 1 plots the respective ΔE values of the above-described 7 exemplary liquid detergent compositions as a function of the NI-to-AI weight ratios in these compositions. It is clear from FIG. 1 that when the NI-to-AI weight ratio is at about 1.5 or below, the clay/soil removal performance of the liquid laundry detergent compositions is relatively poor (as indicated by the higher ΔE values of above 12.0). However, when the NI-to-AI weight ratio is above 1.5, the clay/soil removal performance of the liquid laundry detergent compositions significantly improves (as indicated by the lower ΔE values at the NI-to-AI ratio of 2 and 5). The best clay/soil removal performance is observed when the NI-to-AI ratio of the liquid laundry detergent composition is about 2.

Example 2: Exemplary Liquid Laundry Detergent Compositions

Liquid laundry detergent compositions 1-6 are made by mixing together the ingredients listed in the proportions shown:

TABLE 2

| Ingredients (wt %) | 1 | 2 | 3 | 4 | 5 | 6 |
|---|---|---|---|---|---|---|
| Alkoxylated Polyalkyleneimine I[1] | 0.1-5 | 0.1 | 0.4 | 0.5 | 1 | 2 |
| Alkoxylated Polyalkyleneimine II[2] | 0-2 | — | 0.1 | 1 | — | 0.5 |
| Neodol ®25-7[3] or Neodol ®24-7[4] | 5-45 | 8 | 20 | 15 | 11 | 35 |
| LAS[5] | 0-15 | 2 | 3 | 4 | 3.5 | 4 |
| AE3S[6] | 0-15 | 1 | 8 | 1.5 | 2 | 2 |
| Fatty acids | 0-2 | 1.5 | 0 | 0.5 | 1.2 | 1 |
| Sodium Tetraborate | 0-2 | 0 | 1 | 1.5 | 0.8 | 1.3 |
| Citric acids | 0-2 | 0.5 | 1.5 | 0 | 0.2 | 0.8 |
| Hydrogenated castor oil | 0-0.2 | 0.1 | 0.2 | 0.2 | 0.1 | 0.2 |
| Di-propylene glycol | 0-1 | 0 | 0.5 | 1 | 0.2 | 0 |
| Sodium formate | 0-2 | 1.5 | 0.6 | 0.8 | 0.7 | 0.5 |
| NaCS | 0-0.5 | 0.25 | 0.5 | 0.2 | 0.3 | 0.5 |
| NaOH | pH adjusted to 7.8-8.9 | | | | | |
| Misc. (enzymes, dyes, perfumes, brighteners, chelants, etc.) | 0.5-2 | 0.5-2 | 0.5-2 | 0.5-2 | 0.5-2 | 0.5-2 |
| Water | Q.S. | Q.S. | Q.S. | Q.S. | Q.S. | Q.S. |

[1]An ethoxylated polyethyleneimine with an empirical formula of $PEI_{600}EO_{20}$.
[2]An ethoxylated polyethyleneimine with an empirical formula of $PEI_{600}EO_{24}PO_{16}$.
[3]A $C_{12}$-$C_{15}$ alkyl ethoxylated alcohol with a weight average degree of ethoxylation of 7.
[4]A $C_{12}$-$C_{14}$ alkyl ethoxylated alcohol with a weight average degree of ethoxylation of 7.
[5]A $C_{11}$-$C_{12}$ linear alkylbenzene sulphonate.
[6]A $C_{12-14}$ alkyl ethoxylated sulfate with a weight average degree of ethoxylation of about 3.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm"

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid laundry detergent composition, comprising:

a) from about 0.5 wt % to about 1.5 wt % of an alkoxylated polyethyleneimine with an empirical formula of (PEI)a-(EO)b-(PO)c-$R_1$, wherein a is the weight average molecular weight of the polyalkyleneimine core and is in the range of from about 500 to about 700 Daltons; wherein b is the weight average degree of ethoxylation in said one or more side chains of the alkoxylated polyalkyleneimine and is in the range of from about 15 to about 25; wherein c is the weight average degree of propoxylation in said one or more side chains of the alkoxylatedpolyalkyleneimine and is 0; and wherein $R_1$ is hydrogen;

b) from about 9 wt % to about 15 wt % of a nonionic surfactant that is a $C_{12}$-$C_{15}$ alkyl ethoxylated alcohol having a weight average degree of ethoxylation ranging from about 7 to about 10; and c) from about 2 wt % to about 5 wt % of a combination of a $C_{11}$-$C_{12}$ linear alkyl benzene sulphonate and a $C_{12}$-$C_{14}$ alkylethoxy sulfate having a weight average degree of ethoxylation ranging from about 1 to about 3, wherein the weight ratio of surfactant nonionic to the combination ranges from 2 to about 5.

2. The liquid laundry detergent composition of claim 1, wherein the a is about 600 and the b is about 20.

3. The liquid laundry detergent composition of claim 2, wherein the average degree of ethoxylation of the $C_{12}$-$C_{15}$ alkyl ethoxylated alcohol is about 7.

4. The liquid laundry detergent composition of claim 3, wherein the weight average degree of ethoxylation of the $C_{12}$-$C_{14}$ alkylethoxy sulfate is about 3.

* * * * *